US011341912B2

(12) United States Patent
Feng

(10) Patent No.: US 11,341,912 B2
(45) Date of Patent: May 24, 2022

(54) PIXEL CIRCUIT AND METHOD FOR DRIVING THE SAME, DISPLAY PANEL AND DISPLAY DEVICE

(71) Applicants: CHENGDU BOE OPTOELECTRONICS TECHNOLOGY CO., LTD., Sichuan (CN); BOE TECHNOLOGY GROUP CO., LTD., Beijing (CN)

(72) Inventor: Hongqing Feng, Beijing (CN)

(73) Assignees: CHENGDU BOE OPTOELECTRONICS TECHNOLOGY CO., LTD., Sichuan (CN); BOE TECHNOLOGY GROUP CO., LTD., Beijing (CN)

( * ) Notice: Subject to any disclaimer, the term of this patent is extended or adjusted under 35 U.S.C. 154(b) by 316 days.

(21) Appl. No.: 16/489,079

(22) PCT Filed: Feb. 12, 2019

(86) PCT No.: PCT/CN2019/074839
§ 371 (c)(1),
(2) Date: Aug. 27, 2019

(87) PCT Pub. No.: WO2019/237756
PCT Pub. Date: Dec. 19, 2019

(65) Prior Publication Data

US 2021/0335248 A1 Oct. 28, 2021

(30) Foreign Application Priority Data

Jun. 15, 2018 (CN) ..... 201810619675.2

(51) Int. Cl.
*G09G 3/3241* (2016.01)
*G09G 3/3258* (2016.01)
*G09G 3/3233* (2016.01)

(52) U.S. Cl.
CPC ..... *G09G 3/3241* (2013.01); *G09G 3/3258* (2013.01); *G09G 3/3233* (2013.01);
(Continued)

(58) Field of Classification Search
CPC .. G09G 3/3241; G09G 3/3258; G09G 3/3233; G09G 2300/0842;
(Continued)

(56) References Cited

U.S. PATENT DOCUMENTS 9,230,483 B2 * 1/2016 Tseng ..... G09G 3/3291
9,583,041 B2 * 2/2017 Yin ..... G09G 3/3233
(Continued)

FOREIGN PATENT DOCUMENTS

CN 103198794 A 7/2013
CN 103839520 A 6/2014
(Continued)

OTHER PUBLICATIONS

First Office Action dated Sep. 12, 2019, for corresponding Chinese application 201810619675.2.

*Primary Examiner* — Tom V Sheng
(74) *Attorney, Agent, or Firm* — Nath, Goldberg & Meyer; Joshua B. Goldberg

(57) ABSTRACT

The present disclosure provides a pixel circuit and a method for driving the same, a display panel and a display device. The pixel circuit includes: a reset compensation circuit, a data writing circuit, a light emitting control circuit, a driving transistor and a light emitting element, the reset compensation circuit is coupled to a gate, a first electrode and a second electrode of the driving transistor and a reset control signal line, and is configured to reset the gate of the driving transistor during a reset compensation stage and acquire a
(Continued)

threshold voltage of the driving transistor under the control of a reset control signal provided by the reset control signal line.

13 Claims, 3 Drawing Sheets

(52) U.S. Cl.
CPC ..... *G09G 2300/0819* (2013.01); *G09G 2300/0842* (2013.01); *G09G 2310/0251* (2013.01); *G09G 2310/061* (2013.01); *G09G 2320/0233* (2013.01); *G09G 2320/045* (2013.01); *G09G 2320/0693* (2013.01)

(58) Field of Classification Search
CPC ..... G09G 2300/0819; G09G 2310/061; G09G 2310/0251; G09G 2320/0233; G09G 2320/0693; G09G 2320/045
USPC ..... 345/691
See application file for complete search history.

(56) References Cited

U.S. PATENT DOCUMENTS

| | | | | |
|---|---|---|---|---|
| 9,728,128 | B2 | 8/2017 | Li et al. | |
| 10,192,487 | B2 | 1/2019 | Ma | |
| 10,885,843 | B1 * | 1/2021 | Lu | G09G 3/3233 |
| 10,923,031 | B2 * | 2/2021 | Yang | G09G 3/3258 |
| 10,984,723 | B1 * | 4/2021 | Zhou | G09G 3/3233 |
| 2005/0052377 | A1 * | 3/2005 | Hsueh | G09G 3/3233 345/82 |
| 2006/0170634 | A1 | 8/2006 | Kwak et al. | |
| 2014/0312784 | A1 | 10/2014 | Yin et al. | |
| 2017/0153759 | A1 * | 6/2017 | Ding | G06F 3/0412 |
| 2017/0200414 | A1 * | 7/2017 | Li | G09G 3/3233 |
| 2018/0090071 | A1 * | 3/2018 | Ma | H01L 51/5203 |
| 2018/0374417 | A1 * | 12/2018 | Yang | G09G 3/3233 |
| 2019/0005877 | A1 * | 1/2019 | Dong | G09G 3/3208 |
| 2019/0073955 | A1 * | 3/2019 | Zou | G09G 3/3233 |
| 2019/0180674 | A1 * | 6/2019 | Han | H01L 27/156 |
| 2019/0189054 | A1 * | 6/2019 | Yang | G09G 3/3258 |
| 2019/0295463 | A1 * | 9/2019 | Ling | G09G 3/3225 |
| 2020/0126478 | A1 * | 4/2020 | Lee | G09G 3/3266 |
| 2020/0273411 | A1 * | 8/2020 | Gao | G09G 3/3291 |
| 2021/0118371 | A1 * | 4/2021 | Qing | G09G 3/3266 |
| 2021/0193034 | A1 * | 6/2021 | Li | G09G 3/3233 |

FOREIGN PATENT DOCUMENTS

| | | | |
|---|---|---|---|
| CN | 104464616 | A | 3/2015 |
| CN | 105427800 | A | 3/2016 |
| CN | 108182907 | A | 6/2018 |
| CN | 108281112 | A | 7/2018 |
| CN | 108806605 | A | 11/2018 |

* cited by examiner

PIXEL CIRCUIT AND METHOD FOR DRIVING THE SAME, DISPLAY PANEL AND DISPLAY DEVICE

CROSS-REFERENCE TO RELATED APPLICATIONS

This is a National Phase Application filed under 35 U.S.C. 371 as a national stage of PCT/CN2019/074839, filed Feb. 12, 2019, an application claiming the benefit of Chinese Patent Application No. 201810619675.2, filed on Jun. 15, 2018 the contents of which are incorporated herein in their entirety by reference the content of each of which is hereby incorporated by reference in its entirety.

TECHNICAL FIELD

The present disclosure relates to the field of display technology, and in particular to a pixel circuit, a method for driving the pixel circuit, a display panel and a display device.

BACKGROUND

Light emitting diode (LED) display panels are applied more and more widely. Each LED display panel has a light emitting diode (LED) as a pixel display element, and emits light by driving a transistor to generate a driving current in a saturated state and using the driving current to drive the LED to emit light.

SUMMARY

An embodiment of the present disclosure provides a pixel circuit, including a reset compensation circuit, a data writing circuit, a light emitting control circuit, a driving transistor and a light emitting element, the reset compensation circuit is coupled to a gate, a first electrode and a second electrode of the driving transistor and a reset control signal line, and is configured to reset the gate of the driving transistor during a reset compensation stage and acquire a threshold voltage of the driving transistor under the control of a reset control signal provided by the reset control signal line, the data writing circuit is coupled to the reset compensation circuit, a data line and a gate line, and is configured to transfer a data voltage provided by the data line to the reset compensation circuit so that the reset compensation circuit writes a light emitting voltage to the gate of the driving transistor during a writing stage under the control of a gate driving signal provided by the gate line, the light emitting voltage equals to a sum of the data voltage and the threshold voltage, the light emitting control circuit is coupled to a light emitting control signal line, the first electrode of the driving transistor and a first power supply terminal, and is configured to write a first operation voltage provided by the first power supply terminal to the first electrode of the driving transistor during a light emitting stage under the control of a light emitting control signal provided by the light emitting control signal line, the second electrode of the driving transistor is coupled to a first terminal of the light emitting element, the driving transistor is configured to generate a driving current according to the light emitting voltage and the first operation voltage during the light emitting stage to drive the light emitting element to emit light, and a second terminal of the light emitting element is coupled to a second power supply terminal.

In some implementations, the reset compensation circuit includes a reset sub-circuit and a compensation sub-circuit, the reset sub-circuit is coupled to the gate of the driving transistor and a reset power supply terminal, and is configured to write a reset voltage provided by the reset power supply terminal to the gate of the driving transistor during the reset compensation stage to reset the gate of the driving transistor, the compensation sub-circuit is coupled to the gate, the first electrode and the second electrode of the driving transistor, and is configured to write the reset voltage at the gate of the driving transistor to the second electrode of the driving transistor during the reset compensation stage, acquire an output voltage, which equals to a difference between the reset voltage and the threshold voltage, at the first electrode of the driving transistor, generate the light emitting voltage according to the data voltage and the threshold voltage and write the light emitting voltage to the gate of the driving transistor during the writing stage.

In some implementations, the reset sub-circuit includes a first transistor, a gate of the first transistor is coupled to the reset control signal line, a first electrode of the first transistor is coupled to the gate of the driving transistor, and a second electrode of the first transistor is coupled to the reset power supply terminal.

In some implementations, the compensation sub-circuit includes a second transistor, a third transistor and a capacitor, a gate of the second transistor is coupled to the reset control signal line, a first electrode of the second transistor is coupled to the gate of the driving transistor, a second electrode of the second transistor is coupled to the second electrode of the driving transistor, a gate of the third transistor is coupled to the reset control signal line, a first electrode of the third transistor is coupled to a first terminal of the capacitor, a second electrode of the third transistor is coupled to the first electrode of the driving transistor, and a second terminal of the capacitor is coupled to the gate of the driving transistor.

In some implementations, the data writing circuit includes a fourth transistor, a gate of the fourth transistor is coupled to the gate line, a first electrode of the fourth transistor is coupled to the first terminal of the capacitor and the first electrode of the third transistor of the reset compensation circuit, and a second electrode of the fourth transistor is coupled to the data line.

In some implementations, the light emitting control circuit includes a fifth transistor, a gate of the fifth transistor is coupled to the light emitting control signal line, a first electrode of the fifth transistor is coupled to the first power supply terminal, and the second electrode of the fifth transistor is coupled to the first electrode of the driving transistor.

In some implementations, the pixel circuit further includes an error light emitting control circuit, the second electrode of the driving transistor is coupled to the first terminal of the light emitting element via the error light emitting control circuit, the error light emitting control circuit is coupled to the light emitting control signal line, and is configured to disconnect the second electrode of the driving transistor from the first terminal of the light emitting element during the reset compensation stage under controlling of the light emitting control signal, and connect the second electrode of the driving transistor to the first terminal of the light emitting element during the light emitting stage.

In some implementations, the error light emitting control circuit includes a sixth transistor, a gate of the sixth transistor is coupled to the light emitting control signal line, a first electrode of the sixth transistor is coupled to the second electrode of the driving transistor, and the second electrode of the sixth transistor is coupled to the first terminal of the light emitting element.

In some implementations, all transistors in the pixel circuit are P type transistors.

An embodiment of the present disclosure further provides a pixel circuit, including a first transistor, a second transistor, a third transistor, a fourth transistor, a fifth transistor, a sixth transistor, a capacitor, a driving transistor and a light emitting element, a first electrode of the first transistor, a second terminal of the capacitor, a first electrode of the second transistor and a gate of the driving transistor are coupled to a first node, a first electrode of the third transistor, a first terminal of the capacitor and a first electrode of the fourth transistor are coupled to a second node, a second electrode of the second transistor, a second electrode of the driving transistor and a first electrode of the sixth transistor are coupled to a third node, a first electrode of the driving transistor, a second electrode of the third transistor and a second electrode of the fifth transistor are coupled to a fourth node, gates of the first transistor, the second transistor and the third transistor are coupled to a reset control signal line, gates of the fifth transistor and the sixth transistor are coupled to a light emitting control signal line, a second electrode of the first transistor is coupled to a reset power supply terminal, a gate of the fourth transistor is coupled to a gate line, a second electrode of the fourth transistor is coupled to a data line, a first electrode of the fifth transistor is coupled to a first power supply terminal, a first terminal of the light emitting element is coupled to a second electrode of the sixth transistor, and a second terminal of the light emitting element is coupled to a second power supply terminal.

An embodiment of the present disclosure further provides a display panel including any of pixel circuits as above.

An embodiment of the present disclosure further provides a display device including the display panel as above.

An embodiment of the present disclosure further provides a method for driving the pixel circuit as above, the method includes; during the reset compensation stage, resetting the gate of the driving transistor through the reset compensation circuit, and acquiring the threshold voltage of the driving transistor; during the writing stage, transferring the data voltage to the reset compensation circuit through the data writing circuit so that the reset compensation circuit writes the light emitting voltage, which equals to the sum of the data voltage and the threshold voltage, to the gate of the driving transistor; and during the light emitting stage, writing the first operation voltage to the first electrode of the driving transistor through the light emitting control circuit so that the driving transistor generates the driving current according to the light emitting voltage and the first operation voltage to drive the light emitting element to emit light.

In some implementations, the reset compensation circuit includes a reset sub-circuit and a compensation sub-circuit, the reset sub-circuit is coupled to the gate of the driving transistor and the reset power supply terminal, the compensation sub-circuit is coupled to the gate, the first electrode and the second electrode of the driving transistor, resetting the gate of the driving transistor through the reset compensation circuit and acquiring the threshold voltage of the driving transistor includes: writing an reset voltage provided by the reset power supply terminal to the gate of the driving transistor through the reset sub-circuit, so as to reset the gate of the driving transistor; writing the reset voltage at the gate of the driving transistor to the second electrode of the driving transistor through the compensation sub-circuit, and acquiring an output voltage, which equals to a difference between the reset voltage and the threshold voltage, at the first electrode of the driving transistor.

DESCRIPTION OF EMBODIMENTS

In order to make a person skilled in the art understand technical solutions of the present disclosure better, the pixel circuit, the method for driving the pixel circuit, the display panel and the display device provided by the present disclosure will be described in detail below in conjunction with accompanying drawings.

An LED display panel generally has a poor uniformity of threshold voltages of driving transistors, and during a procedure of usage, the threshold voltages of the driving transistors usually drift. Thus, when a gate line (scan line) controls switch transistors to be turned on so as to input a same data voltage to driving transistors, the driving transistors generate different driving current due to their different threshold voltages, which results in a poor uniformity of luminance of LEDs in the display device including the LED display panel.

Figure 1:
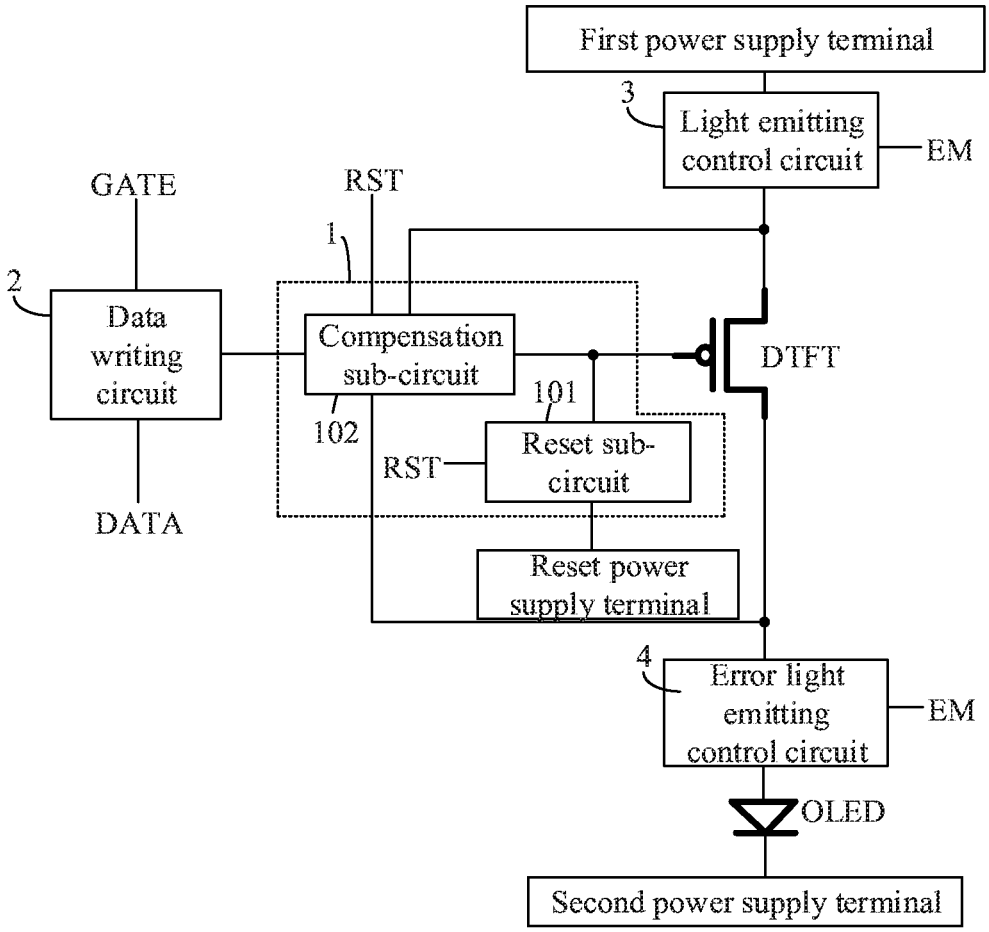
FIG. 1 shows a structural diagram of a pixel circuit in an embodiment of the present disclosure.

For example, a threshold voltage compensation circuit may be provided in a pixel circuit to compensate the threshold voltage of each driving transistor. The threshold voltage compensation circuit is generally composed of multiple transistors. However, the threshold voltage compensation circuit needs to be equipped with multiple control signal lines and a corresponding control chip. In order to control the threshold voltage compensation circuit to operate, a number of control signal sources need to be provided in the control chip. In such way, the threshold voltage compensation circuit in the pixel circuit has a complex structure, and many control signal lines and control signal sources are required, which leads to a large overall power consumption of the pixel circuit. FIG. 1 shows a structural diagram of a pixel circuit in an embodiment of the present disclosure. As shown in FIG. 1, the pixel circuit includes a reset compensation circuit 1, a data writing circuit 2, a light emitting control circuit 3, a driving transistor DTFT and a light emitting element. In the embodiment, the light emitting element may be for example an organic light emitting diode (OLED). Alternatively, the light emitting element may also be any other current driven light emitting diode.

In some implementations, the reset compensation circuit 1 is coupled to a gate, a first electrode and a second electrode of the driving transistor MITT and a reset control signal line RST, and is configured to reset the gate of the driving transistor DTFT during a reset compensation stage and acquire a threshold voltage of the driving transistor DTFT under the control of a reset control signal provided by the reset control signal line RST.

The data writing circuit 2 is coupled to the reset compensation circuit 1, a data line DATA and a gate line GATE, and is configured to transfer a data voltage provided by the data line DATA to the reset compensation circuit 1 so that the reset compensation circuit 1 writes a light emitting voltage to the gate of the driving transistor DTFT during a writing stage under the control of a gate driving signal provided by the gate line GATE, the light emitting voltage equals to a sum of the data voltage and the threshold voltage.

The light emitting control circuit 3 is coupled to a light emitting control signal line EM, the first electrode of the driving transistor DTFT and a first power supply terminal, and is configured to write a first operation voltage provided by the first power supply terminal to the first electrode of the driving transistor DTFT during a light emitting stage under the control of a light emitting control signal provided by the light emitting control signal line EM.

The second electrode of the driving transistor DTFT is coupled to a first terminal (e.g., an anode) of the light emitting element (e.g., OLED), the driving transistor DTFT is configured to generate a driving current according to the light emitting voltage and the first operation voltage during the light emitting stage to drive the light emitting element to emit light. A second terminal (e.g., a cathode) of the light emitting element is coupled to a second power supply terminal (e.g., a low voltage terminal or a ground terminal).

In the embodiment, a circuit for resetting the gate of the driving transistor DTFT and a circuit for compensating the threshold voltage of the driving transistor DTFT are integrated into a single circuit, i.e., the reset compensation circuit 1, and in addition to a reset power supply terminal for providing a reset voltage, only the reset control signal line RST for providing the reset control signal needs to be provided for the reset compensation circuit 1, thus in the pixel circuit of the embodiment, the reset compensation circuit 1 not only can reset the gate of the driving transistor under the control of the reset control signal provided by the reset control signal line RST, but also can compensate the threshold voltage of the driving transistor, and no additional control signal line is needed for compensating the threshold voltage. The technical solution of the embodiment can effectively reduce the number of control signal lines and types of control signals in a case where the compensation for the threshold voltage of the driving transistor DTFT is achieved, resulting in a simple structure of the pixel circuit and a low power consumption.

In some implementations, the reset compensation circuit 1 includes a reset sub-circuit 101 and a compensation sub-circuit 102.

The reset sub-circuit 101 is coupled to the gate of the driving transistor DTFT and a reset power supply terminal, and is configured to write a reset voltage provided by the reset power supply terminal to the gate of the driving transistor DTFT during the reset compensation stage to reset the gate of the driving transistor.

The compensation sub-circuit 102 is coupled to the gate, the first electrode and the second electrode of the driving transistor DTFT, and is configured to write the reset voltage at the gate of the driving transistor DTFT to the second electrode of the driving transistor DTFT during the reset compensation stage, acquire an output voltage, which equals to a difference between the reset voltage and the threshold voltage, at the first electrode of the driving transistor DTFT, generate the light emitting voltage according to the data voltage and the threshold voltage and write the light emitting voltage to the gate of the driving transistor DTFT during the writing stage.

In the embodiment, only the reset control signal line RST needs to be provided for providing the reset control signal so that operation states of the reset sub-circuit 101 and the compensation sub-circuit 102 can be controlled.

In some implementations, the pixel circuit further includes an error light emitting control circuit 4, the second electrode of the driving transistor DTFT is coupled to the first terminal of the light emitting element via the error light emitting control circuit 4, the error light emitting control circuit 4 is coupled to the light emitting control signal line EM, and is configured to disconnect the second electrode of the driving transistor DTFT from the first terminal of the light emitting element during the reset compensation stage under the control of the light emitting control signal, and connect the second electrode of the driving transistor DTFT to the first terminal of the light emitting element during the light emitting stage.

During the reset compensation stage, when the reset voltage is input to the gate and the second electrode of the driving transistor DTFT, the first electrode of the driving transistor DTFT discharges through the driving transistor DTFT, thus the driving transistor DTFT outputs an unstable current, which may result in an error light emitting of the light emitting element (detailed later). In order to avoid that the light emitting element emits light erroneously, the error light emitting control circuit 4 is provided in the embodiment to disconnect the second electrode of the driving transistor DTFT from the first terminal of the light emitting element during the reset compensation stage, thereby the light emitting element emitting light erroneously can be avoided.

In the pixel circuit of the embodiment, by integrating the circuit for resetting the gate of the driving transistor DTFT and the circuit for compensating the threshold voltage of the driving transistor into the single circuit which only needs the reset control signal line for providing the reset control signal, the number of control signal lines and types of control signals can be effectively reduced in a case where the compensation for the threshold voltage of the driving transistor DTFT is achieved, resulting in a simple structure of the pixel circuit and a low power consumption.

Figure 2:
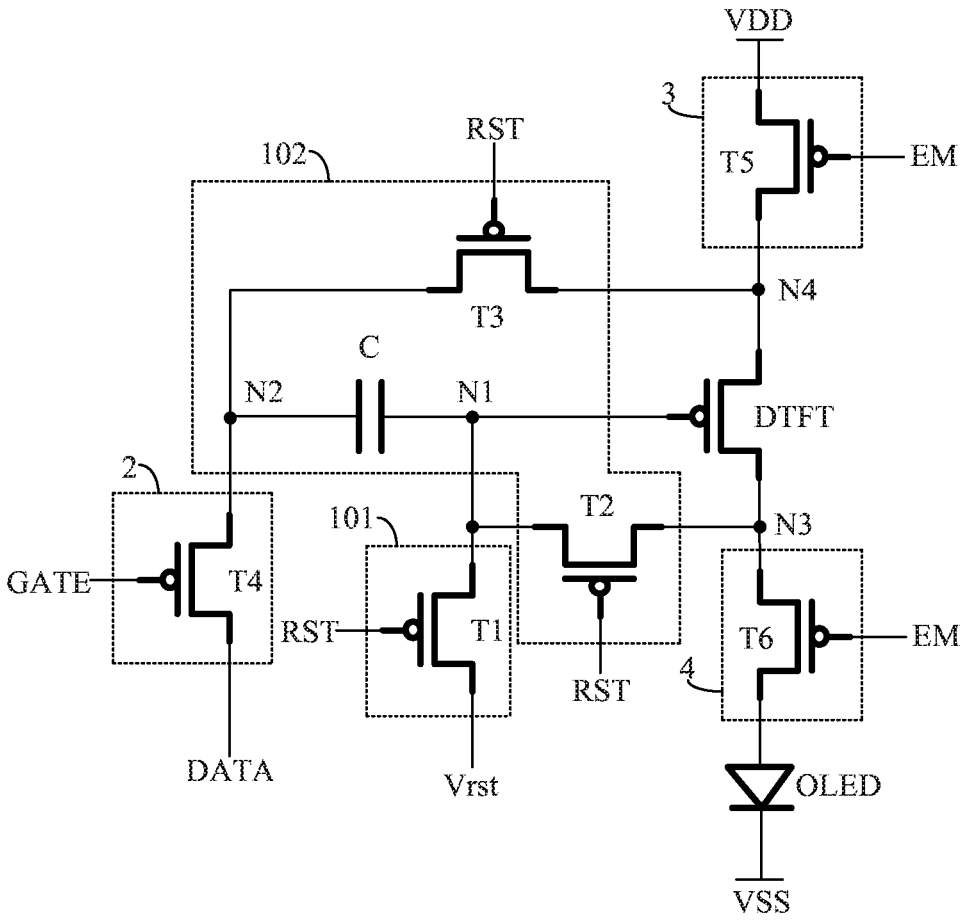
FIG. 2 shows a circuit diagram of a pixel circuit in an embodiment of the present disclosure.

FIG. 2 shows a circuit diagram of a pixel circuit in an embodiment of the present disclosure. The pixel circuit shown in FIG. 2 is a specific implementation of the pixel circuit in the above embodiment.

In the embodiment, the reset sub-circuit 101 includes a first transistor T1, a gate of the first transistor T1 is coupled to the reset control signal line RST, a first electrode of the first transistor T1 is coupled to the gate of the driving transistor DTFT, and a second electrode of the first transistor T1 is coupled to the reset power supply terminal.

In the embodiment, the compensation sub-circuit 102 includes a second transistor T2, a third transistor T3 and a capacitor C.

A gate of the second transistor T2 is coupled to the reset control signal line RST, a first electrode of the second transistor T2 is coupled to the gate of the driving transistor DTFT, a second electrode of the second transistor T2 is coupled to the second electrode of the driving transistor DTFT.

A gate of the third transistor T3 is coupled to the reset control signal line RST, a first electrode of the third transistor T3 is coupled to a first terminal of the capacitor C, a second electrode of the third transistor T3 is coupled to the first electrode of the driving transistor DTFT.

A second terminal of the capacitor C is coupled to the gate of the driving transistor DTFT.

In the embodiment, the data writing circuit 2 includes a fourth transistor. T4.

A gate of the fourth transistor T4 is coupled to the gate line GATE, a first electrode of the fourth transistor T4 is coupled to the first terminal of the capacitor C and the first electrode of the third transistor T3 of the reset compensation circuit 1, and a second electrode of the fourth transistor T4 is coupled to the data line DATA.

In the embodiment, the light emitting control circuit 3 includes a fifth transistor T5.

A gate of the fifth transistor T5 is coupled to the light emitting control signal line EM, a first electrode of the fifth transistor T5 is coupled to the first power supply terminal, and the second electrode of the fifth transistor T5 is coupled to the first electrode of the driving transistor DTFT.

In the embodiment, the error light emitting control circuit 4 includes a sixth transistor T6.

A gate of the sixth transistor T6 is coupled to the light emitting control signal line EM, a first electrode of the sixth transistor T6 is coupled to the second electrode of the driving transistor DTFT, and the second electrode of the sixth transistor T6 is coupled to the first terminal of the light emitting element.

In the embodiment, all the transistors may be one type of polycrystalline silicon thin film transistors, amorphous silicon thin film transistors, oxide thin film transistors and organic thin film transistors. In the embodiment, the term of "first electrode" may refer to a source electrode of a transistor, and the term of "second electrode" may refer to a drain electrode of the transistor. Certainly, persons skilled in the art should understand that, the "first electrode" and the "second electrode" may be exchanged, that is, the term of "first electrode" may also refer to the drain electrode of the transistor, and the term of "second electrode" may also refer to the source electrode of the transistor.

In the embodiment, all the transistors in the pixel circuit may be P type transistors, in such case, the transistors may be manufactured simultaneously by a single manufacturing process, and a production period of the pixel circuit is shortened. It should be noted that, all the transistors in the pixel circuit being P type thin film transistors is only an option to the embodiment, the technical solution of the present disclosure is not limited thereto. In another embodiment, the driving transistor may be a P type thin film transistor, and the other transistors (the first transistor T1 through the sixth transistor T6) may be N type transistors.

An operation procedure of the pixel circuit of the embodiment will be described in detail below in conjunction with the accompanying drawings. In the descriptions below, an example in which all the driving transistor DTFT, and the first transistor T1 through the sixth transistor T6 are P type thin film transistors is taken for illustrating, in such case, the first power supply terminal provides a first operation voltage VDD, the second power supply terminal provides a second operation voltage VSS (e.g., a ground voltage), the reset power supply terminal provides a reset voltage Vrst, and the threshold voltage of the driving transistor DTFT is Vth. Furthermore, as shown in FIG. 2, a node coupled to the first electrode of the first transistor T1, the second terminal of the capacitor C, the first electrode of the second transistor T2 and the gate of the driving transistor DTFT is marked as N1, a node coupled to the first electrode of the third transistor T3, the first terminal of the capacitor C and the first electrode of the fourth transistor T4 is marked as N2, a node coupled to the second electrode of the second transistor T2, the second electrode of the driving transistor DTFT and the first electrode of the sixth transistor T6 is marked as N3, and a node coupled to the first electrode of the driving transistor DTFT, the second electrode of the third transistor T3 and the second electrode of the fifth transistor T5 is marked as N4.

Figure 3:
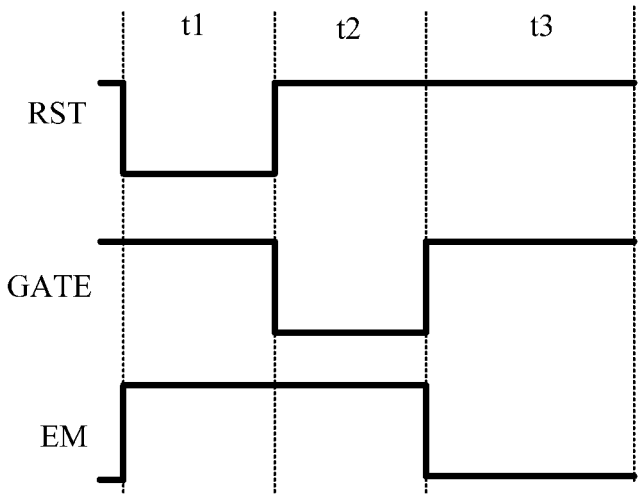
FIGS. 3 and 4 show timing diagrams of operations of the pixel circuit shown in FIG. 2.

FIG. 3 shows a timing diagram of an operation of the pixel circuit shown in FIG. 2. As shown in FIG. 3, the operation procedure of the pixel circuit includes three stages, that is, a reset compensation stage t1, a writing stage t2 and a light emitting stage t3.

During the reset compensation stage t1, the reset control signal provided by the reset control signal line RST is at a low level, the gate driving signal (also referred to as scanning signal) provided by the gate line GATE is at a high level, and the light emitting control signal provided by the light emitting control signal line EM is at the high level.

In such case, the first transistor T1, the second transistor T2 and the third transistor T3 are all turned on, and the fourth transistor T4, the fifth transistor T5 and the sixth transistor T6 are all turned off.

Since the first transistor T1 is turned on, the reset voltage Vrst provided by the reset power supply terminal is written to the first node N1 through the first transistor T1, and simultaneously, since the second transistor T2 is turned on, the reset voltage Vrst at the first node N1 is written to the third node N3 through the second transistor T2. In such case, the fourth node N4 (the voltage of the fourth node N4 is the first operation voltage VDD at an end of displaying of the previous frame of image) discharges through the driving transistor DTFT, until the voltage of the fourth node N4 equals to Vrst−Vth, at this time, the driving transistor DTFT is turned off. Further, since the third transistor T3 is turned on, the voltage at the fourth node N4 is written to the second node N2 through the third transistor T3, and the voltage at the second node N2 equals to Vrst−Vth.

In such case, the voltage at the first terminal of the capacitor C equals to Vrst−Vth, the voltage at the second terminal of the capacitor C equals to Vrst, and a voltage difference across the first terminal and the second terminal of the capacitor C equals to −Vth.

It should be noted that, since the sixth transistor T6 is turned off, during discharging of the fourth node N4 through the driving transistor DTFT, the current output from the driving transistor DTFT cannot be transferred to the light emitting element (e.g., OLED), the light emitting element (e.g., OILED) will not emit light erroneously.

During the writing stage t2, the reset control signal provided by the reset control signal line RST is at the high level, the gate driving signal provided by the gate line GATE is at the low level, and the light emitting control signal provided by the light emitting control signal line EM is at the high level.

In such case, the fourth transistor T4 is turned on, and the first transistor T1, the second transistor T2, the third transistor T3, the fifth transistor T5 and the sixth transistor T6 are all turned off.

Since the fourth transistor T4 is turned on, the data voltage Vdata of the data line DATA is written to the second node N2 through the fourth transistor T4, the voltage at the second node N2 jumps from Vrst−Vth to Vdata. Further, since the first transistor T1 and the second transistor T2 are turned off, the first node N1 is at a floating state, under a bootstrap effect of the capacitor (i.e., a voltage difference across two terminals of the capacitor keeps unchanged), the voltage at the first node N1 jumps from Vrst−Vth to Vdata+Vth.

During the light emitting stage t3, the reset control signal provided by the reset control signal line RST is at the high level, the gate driving signal provided by the gate line GATE is at the high level, and the light emitting control signal provided by the light emitting control signal line EM is at the low level.

In such case, the fifth transistor T5 and the sixth transistor T6 are turned on, and the first transistor T1, the second transistor T2, the third transistor T3 and the fourth transistor T4 are all turned off.

Since the fifth transistor. T5 is turned on, the first operation voltage VDD is written to the fourth node N4 through the fifth transistor. T5, the gate-to-source voltage Vgs (a voltage difference between the gate and the source electrode) of the driving transistor DTFT equals to Vdata+Vth−VDD.

According to a formula of driving current in saturated state of the driving transistor DTFT, the following formula is obtained.

$$I=K*(Vgs-Vth)^2$$

$$=K*(V\text{data}+Vth-VDD-Vth)^2$$

$$=K*(V\text{data}-VDD)^2$$

Where I represents the driving current output by the driving transistor DTFT, and K is a constant which is related to channel characteristics of the driving transistor DTFT.

From the above formula, during the light emitting stage t3, the driving current output by the driving transistor DTFT is not related to the threshold voltage of the driving transistor DTFT, that is, the threshold voltage of the driving transistor DTFT is compensated, a problem of uneven luminance of the display panel caused by different threshold voltages of driving transistors can be solved.

In addition, from the contents above, the reset control signal line in the reset sub-circuit is also used as the control signal line of the compensation 115 sub-circuit in the pixel circuit of the embodiment, no additional control signal line needs to be provided for the compensation sub-circuit, the number of control signal lines and types of control signals for the pixel circuit can be effectively reduced, resulting in a simple structure of the pixel circuit and a low power consumption.

Figure 4:
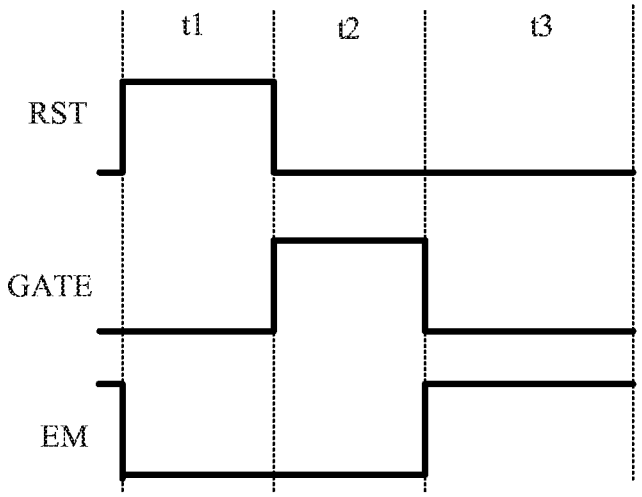

It should be understood that, in a case where the first transistor T1 through the sixth transistor T6 are N type transistors, the timing diagram of operation of the pixel circuit is as shown in FIG. 4.

Figure 5:
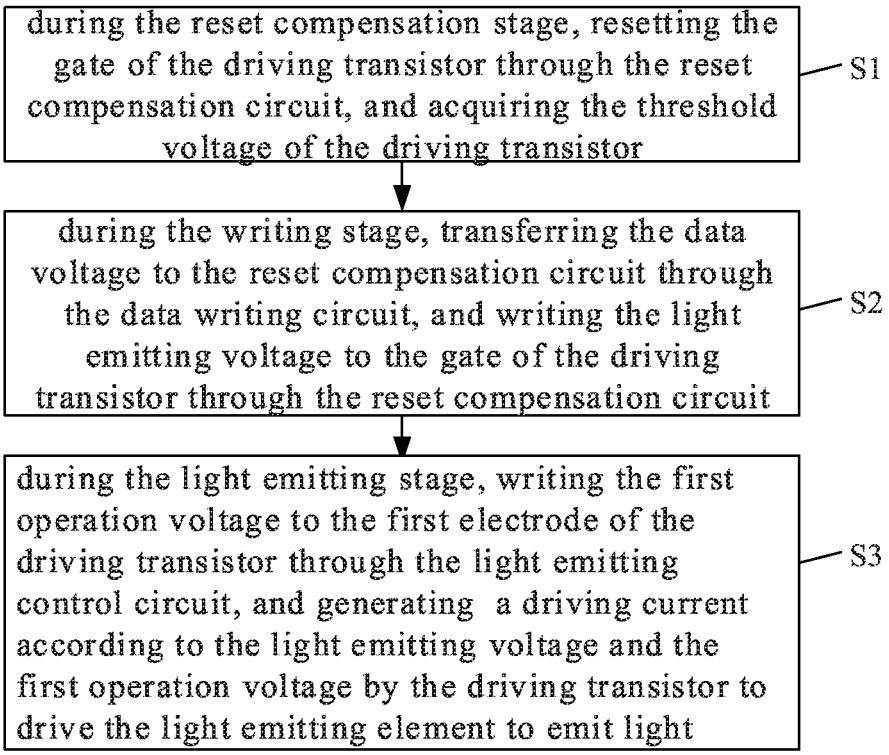
FIG. 5 shows a flow chart of a method for driving a pixel circuit in an embodiment of the present disclosure.

FIG. 5 shows a flow chart of a method for driving the pixel circuit in the above embodiment of the present disclosure. The method includes following steps S1 through S3.

At step S1, during the reset compensation stage, the gate of the driving transistor is reset through the reset compensation circuit, and the threshold voltage of the driving transistor is acquired.

In some implementations, the reset compensation circuit may include the reset sub-circuit and the compensation sub-circuit. In such case, the step S1 includes: at a sub-step S101, writing the reset voltage provided by the reset power supply terminal to the gate of the driving transistor through the reset sub-circuit, to reset the gate of the driving transistor; at a sub-step S102, writing the reset voltage at the gate of the driving transistor to the second electrode of the driving transistor through the compensation sub-circuit, and acquiring the output voltage, which equals to the difference between the reset voltage and the threshold voltage, at the first electrode of the driving transistor.

At step S2, during the writing stage, the data voltage is transferred to the reset compensation circuit through the data writing circuit, and the light emitting voltage, which equals to the sum of the data voltage and the threshold voltage, is written to the gate of the driving transistor through the reset compensation circuit.

At step S3, during the light emitting stage, the first operation voltage is written to the first electrode of the driving transistor through the light emitting control circuit, and the driving transistor generates a driving current according to the light emitting voltage and the first operation voltage to drive the light emitting element to emit light.

Specific descriptions of the steps S1 through S3 may refer to corresponding contents in above embodiments, and will not be repeated here.

An embodiment of the present disclosure further provides a display panel including the pixel circuit of the above embodiments, specific descriptions thereof may refer to corresponding contents in above embodiments, and will not be repeated here. The display panel of the embodiment may be an OLED display panel manufactured by a low temperature polycrystalline silicon process, or the like.

An embodiment of the present disclosure further provides a display device including the display panel in the above embodiment, specific descriptions thereof may refer to corresponding contents in above embodiments, and will not be repeated here.

It should be understood that, the above embodiments and implementations are merely exemplary embodiments and implementations for explaining principle of technical solutions of the present disclosure, but the present disclosure is not limited thereto. Various modifications and variants may be made by those ordinary skilled in the art within the spirit and essence of the present disclosure, these modifications and variants also fall into the protection scope of the present disclosure.

The invention claimed is:

1. A pixel circuit, comprising a reset compensation circuit, a data writing circuit, a light emitting control circuit, a driving transistor and a light emitting element, wherein the reset compensation circuit is coupled to a gate, a first electrode and a second electrode of the driving transistor and a reset control signal line, and is configured to reset the gate of the driving transistor during a reset compensation stage and acquire a threshold voltage of the driving transistor under the control of a reset control signal provided by the reset control signal line, the data writing circuit is coupled to the reset compensation circuit, a data line and a gate line, and is configured to transfer a data voltage provided by the data line to the reset compensation circuit so that the reset compensation circuit writes a light emitting voltage to the gate of the driving transistor during a writing stage under the control of a gate driving signal provided by the gate line, the light emitting voltage equals to a sum of the data voltage and the threshold voltage, the light emitting control circuit is coupled to a light emitting control signal line, the first electrode of the driving transistor and a first power supply terminal, and is configured to write a first operation voltage provided by the first power supply terminal to the first electrode of the driving transistor during a light emitting stage under the control of a light emitting control signal provided by the light emitting control signal line, the second electrode of the driving transistor is coupled to a first terminal of the light emitting element, the driving transistor is configured to generate a driving current according to the light emitting voltage and the first operation voltage during the light emitting stage to drive the light emitting element to emit light, and a second terminal of the light emitting element is coupled to a second power supply terminal, wherein the reset compensation circuit comprises a reset sub-circuit and a compensation sub-circuit, the reset sub-circuit is coupled to the gate of the driving transistor and a reset power supply terminal, and is configured to write a reset voltage provided by the reset power supply terminal to the gate of the driving transistor during the reset compensation stage to reset the gate of the driving transistor, the compensation sub-circuit is coupled to the gate, the first electrode and the second electrode of the driving transistor, and is configured to write the reset voltage at the gate of the driving transistor to the second electrode of the driving transistor during the reset compensation stage, acquire an output voltage, which equals to a difference between the reset voltage and the threshold voltage, at the first electrode of the driving transistor, generate the light emitting voltage according to the data voltage and the threshold voltage and write the light emitting voltage to the gate of the driving transistor during the writing stage.

2. The pixel circuit of claim 1, wherein the reset sub-circuit comprises a first transistor, a gate of the first transistor is coupled to the reset control signal line, a first electrode of the first transistor is coupled to the gate of the driving transistor, and a second electrode of the first transistor is coupled to the reset power supply terminal.

3. The pixel circuit of claim 1, wherein the compensation sub-circuit includes a second transistor, a third transistor and a capacitor, a gate of the second transistor is coupled to the reset control signal line, a first electrode of the second transistor is coupled to the gate of the driving transistor, a second electrode of the second transistor is coupled to the second electrode of the driving transistor, a gate of the third transistor is coupled to the reset control signal line, a first electrode of the third transistor is coupled to a first terminal of the capacitor, a second electrode of the third transistor is coupled to the first electrode of the driving transistor, and a second terminal of the capacitor is coupled to the gate of the driving transistor.

4. The pixel circuit of claim 3, wherein the data writing circuit comprises a fourth transistor, a gate of the fourth transistor is coupled to the gate line, a first electrode of the fourth transistor is coupled to the first terminal of the capacitor and the first electrode of the third transistor of the reset compensation circuit, and a second electrode of the fourth transistor is coupled to the data line.

5. The pixel circuit of claim 1, wherein the light emitting control circuit comprises a fifth transistor, a gate of the fifth transistor is coupled to the light emitting control signal line, a first electrode of the fifth transistor is coupled to the first power supply terminal, and the second electrode of the fifth transistor is coupled to the first electrode of the driving transistor.

6. The pixel circuit of claim 1, further comprising an error light emitting control circuit, the second electrode of the driving transistor is coupled to the first terminal of the light emitting element via the error light emitting control circuit, the error light emitting control circuit is coupled to the light emitting control signal line, and is configured to disconnect the second electrode of the driving transistor from the first terminal of the light emitting element during the reset compensation stage under the control of the light emitting control signal, and connect the second electrode of the driving transistor to the first terminal of the light emitting element during the light emitting stage.

7. The pixel circuit of claim 6, wherein the error light emitting control circuit comprises a sixth transistor, a gate of the sixth transistor is coupled to the light emitting control signal line, a first electrode of the sixth transistor is coupled to the second electrode of the driving transistor, and the second electrode of the sixth transistor is coupled to the first terminal of the light emitting element.

8. The pixel circuit of claim 1, wherein all transistors in the pixel circuit are P type transistors.

9. A display panel, comprising the pixel circuit of claim 1.

10. A display device, comprising the display panel of claim 9.

11. A method for driving the pixel circuit of claim 1, the method comprising:

during the reset compensation stage, resetting the gate of the driving transistor through the reset compensation circuit, and acquiring the threshold voltage of the driving transistor;

during the writing stage, transferring the data voltage to the reset compensation circuit through the data writing circuit so that the reset compensation circuit writes the light emitting voltage, which equals to the sum of the data voltage and the threshold voltage, to the gate of the driving transistor; and during the light emitting stage, writing the first operation voltage to the first electrode of the driving transistor through the light emitting control circuit so that the driving transistor generates the driving current according to the light emitting voltage and the first operation voltage to drive the light emitting element to emit light.

12. The method of claim 11, wherein the reset compensation circuit comprises a reset sub-circuit and a compensation sub-circuit, the reset sub-circuit is coupled to the gate of the driving transistor and the reset power supply terminal, the compensation sub-circuit is coupled to the gate, the first electrode and the second electrode of the driving transistor, resetting the gate of the driving transistor through the reset compensation circuit and acquiring the threshold voltage of the driving transistor comprising:

writing reset voltage provided by the reset power supply terminal to the gate of the driving transistor through the reset sub-circuit, so as to reset the gate of the driving transistor;

writing the reset voltage at the gate of the driving transistor to the second electrode of the driving transistor through the compensation sub-circuit, and acquiring an output voltage, which equals to a difference between the reset voltage and the threshold voltage, at the first electrode of the driving transistor.

13. A pixel circuit, comprising a first transistor, a second transistor, a third transistor, a fourth transistor, a fifth transistor, a sixth transistor, a capacitor, a driving transistor and a light emitting element, wherein a first electrode of the first transistor, a second terminal of the capacitor, a first electrode of the second transistor and a gate of the driving transistor are coupled to a first node, a first electrode of the third transistor, a first terminal of the capacitor and a first electrode of the fourth transistor are coupled to a second node, a second electrode of the second transistor, a second electrode of the driving transistor and a first electrode of the sixth transistor are coupled to a third node, a first electrode of the driving transistor, a second electrode of the third transistor and a second electrode of the fifth transistor are coupled to a fourth node, gates of the first transistor, the second transistor and the third transistor are coupled to a reset control signal line, gates of the fifth transistor and the sixth transistor are coupled to a light emitting control signal line, a second electrode of the first transistor is coupled to a reset power supply terminal, a gate of the fourth transistor is coupled to a gate line, a second electrode of the fourth transistor is coupled to a data line, a first electrode of the fifth transistor is coupled to a first power supply terminal, a first terminal of the light emitting element is coupled to a second electrode of the sixth transistor, and a second terminal of the light emitting element is coupled to a second power supply terminal.

* * * * *